US006682449B2

(12) United States Patent
Foulke

(10) Patent No.: US 6,682,449 B2
(45) Date of Patent: Jan. 27, 2004

(54) FLYING TOY AND METHOD OF MAKING SAME

(76) Inventor: Robert W. Foulke, 122 Avenida Domingues, No. 3A, San Clemente, CA (US) 92672

( * ) Notice: Subject to any disclaimer, the term of this patent is extended or adjusted under 35 U.S.C. 154(b) by 0 days.

(21) Appl. No.: 10/164,504

(22) Filed: Jun. 6, 2002

(65) Prior Publication Data

US 2002/0151395 A1 Oct. 17, 2002

Related U.S. Application Data

(62) Division of application No. 09/612,787, filed on Jul. 10, 2000, now Pat. No. 6,443,861.

(51) Int. Cl.[7] ..... A63B 65/08
(52) U.S. Cl. ..... 473/588; 473/590; 446/46
(58) Field of Search ..... 473/590, 588, 473/613, 607; 446/46; 83/13, 55

(56) References Cited

U.S. PATENT DOCUMENTS 532,233 A 1/1895 Faxon
1,040,702 A 10/1912 Lee
2,361,988 A 11/1944 Bonnifield
4,222,573 A 9/1980 Adler
4,379,813 A * 4/1983 Newnham ..... 446/217
5,603,497 A * 2/1997 Louez ..... 473/607
5,797,815 A 8/1998 Goldman et al.
5,906,529 A 5/1999 Spais
6,179,738 B1 * 1/2001 Perthou ..... 473/590
6,294,237 B1 * 9/2001 Popat ..... 473/590

* cited by examiner

*Primary Examiner*—Steven Wong
(74) *Attorney, Agent, or Firm*—Stetina Brunda Garred & Brucker

(57) ABSTRACT

The present invention is a boomerang flying toy having a plurality of blade arms with airfoil-like tapered perimeter edges along their respective cut lines to give the boomerang toy improved aerodynamic performance characteristics. The blade arms extend radially outward at equal angles from a central hub, where they are coupled together by interlocking fastener plates or self-adhesive decals affixed to the top and bottom surfaces at the junction of the blade arms. The top and bottom surfaces have optically perceived indicia to increase the toy's appearance and can be used to display a wide range of information including graphics, logos, advertisement, sales, and promotional information. An additional flying ring toy is die cut at the same time as the boomerang with only two additional circular cuts. The flying ring toy has the same enhanced flight performance and optically perceived indicia. A method of making the boomerang and flying ring toys in combination is by die cutting a sheet of thin, lightweight planar material comprising a foam center sandwiched between top and bottom opposed parallel surfaces of paperboard stock.

20 Claims, 4 Drawing Sheets

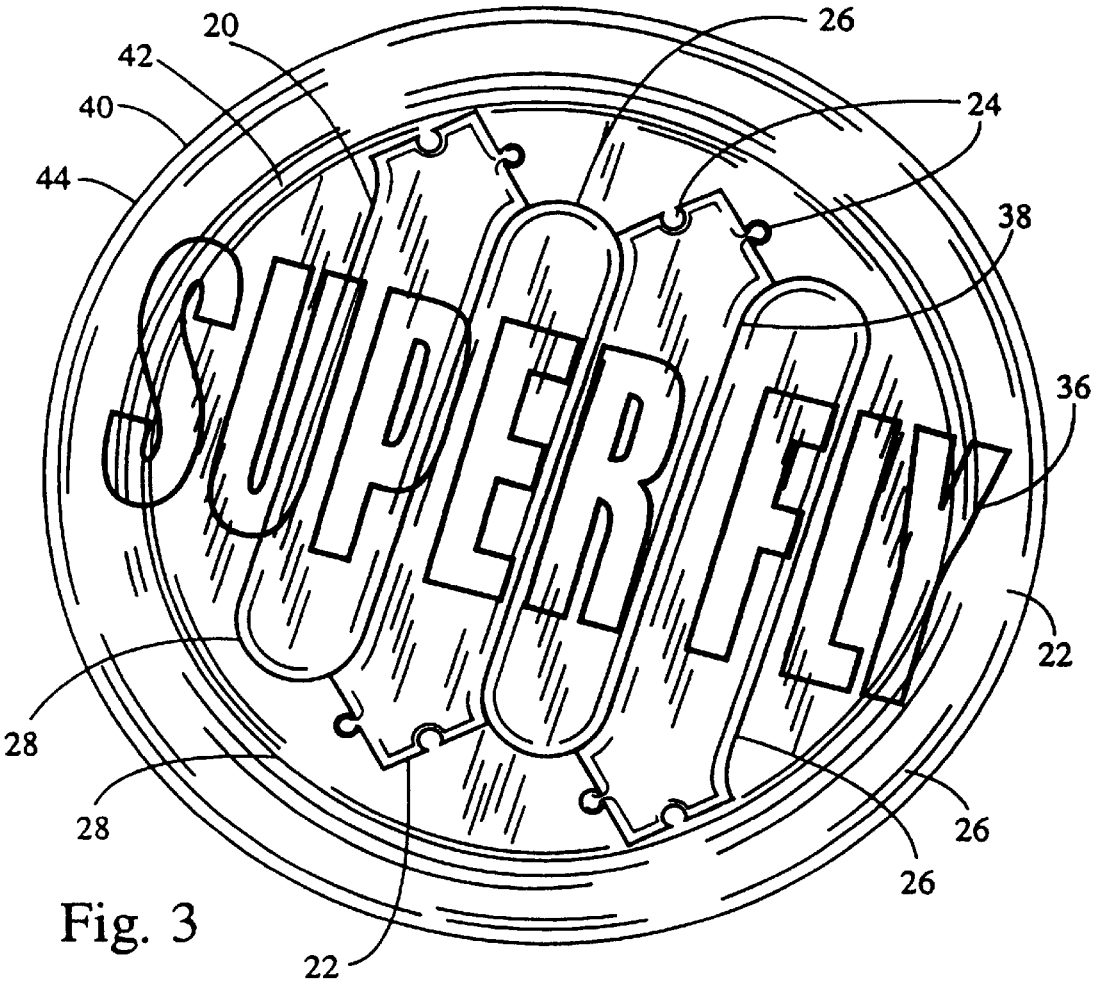
Fig. 3
Fig. 4
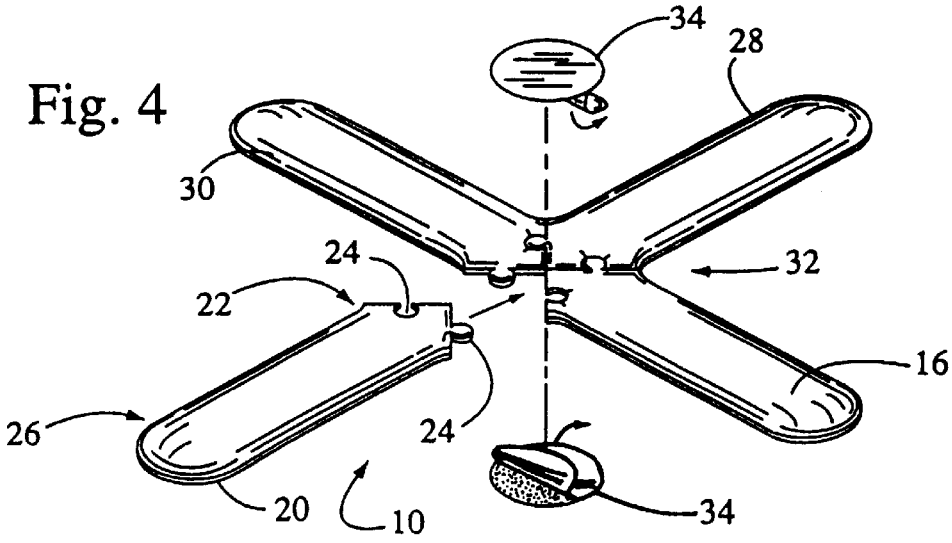

FLYING TOY AND METHOD OF MAKING SAME

CROSS-REFERENCE TO RELATED APPLICATIONS

The present application is a divisional of U.S. patent application Ser. No. 09/612,787 entitled FLYING TOY AND METHOD OF MAKING SANE filed Jul. 10, 2000, which has now issued as U.S. Pat. No. 6,443,861 B1.

STATEMENT RE: FEDERALLY SPONSORED RESEARCH/DEVELOPMENT (Not Applicable)

FIELD OF THE INVENTION

The present invention relates generally to flying toys and more particularly to boomerangs and flying ring toys adapted to be thrown by a user and methods of making such toys.

BACKGROUND OF THE INVENTION

Boomerang type hand-thrown flying devices designed for purposes of sport and hunting originated in the early aboriginal days when such devices were used as weapons for fighting and hunting. When thrown properly by the user the boomerang would fly in a circle, spinning rapidly and return to the thrower if it missed its target. These early boomerangs were predominantly v-shaped and made of heavy wood with sharpened edges in order to disable a target when struck. The design made catching such devices upon their return inherently dangerous, so the thrower would generally let the boomerang hit the ground near their feet.

More recently many hand-launched boomerang type toys have been designed for purposes of entertainment and competition. Flying toys have been designed and improved upon over the years, with improved return flight performance and the ability to be safely caught by the thrower upon return. Many of these devices have multiple blades extending from a central hub, and are constructed of light woods, rigid plastic material, and other lightweight materials to improve flight characteristics such as lift, flight distance and return flight. Some devices are made with a rigid metal core covered with soft rubber material to allow the thrower to safely catch them on their return flight.

Other related flying toys have been developed such as the Aerobie, the Frisbee, and flying ring type toys. Unlike boomerangs, which generally travel in a circular path parallel to the ground, these devices are either thrown from person to person in a horizontal line, or thrown upwardly at an angle and they slide back down to the original thrower. To improve their flight performance characteristics, some of the boomerang and flying ring or disc toys have aerodynamic features, such as lifting surfaces, arms that bend upwards as they extend from a central hub, airfoil features at the ends of the arms, and portions of convex or concave surfaces. Making such devices, however, has proved challenging because enhancing flying toys with such aerodynamic features requires a plurality of steps to manufacture the device, thereby increasing their complexity and cost. The end users of such devices, in addition to having to assemble the parts with medium to high degrees of precision, may have to adjust the parts by bending the arms to optimum angles or aerodynamic shapes in order for the flying toys to exhibit certain flight characteristics, such as return flight. This process can be very frustrating to the users, especially when the users are children, who very quickly lose interest when the toys do not perform as they are shown to perform in commercials and other advertisements.

One of the difficulties encountered by manufacturers of flying toys is that a lot of material is wasted due to the design of blade arms or circular discs of rather large radii, which are unitary pieces cut or formed from large standard size sheets of material such as plastic or lightweight wood. Additionally, the volume required for shipping and in-store display of such devices has traditionally been excessive due to their size and fragility.

Accordingly, there is a substantial need in the art for improved flying toys and methods for making the same to overcome the problems noted above, and which improve "off the shelf" flight characteristics, improve safe use, can be inexpensively made with little or no wasted material, and can be shipped and displayed at minimal cost.

SUMMARY OF THE INVENTION

The present invention specifically addresses and alleviates the above mentioned deficiencies associated with the prior art. In this regard, the present invention comprises improved boomerang and flying ring toys and methods of making such toys.

The boomerang flying toy has a plurality of blade arms with tapered perimeter edges along their respective cut lines, which act like airfoils to give the boomerang flying toy improved aerodynamic performance characteristics. The blade arms extend radially outward at equal angles from a central hub portion, where they are held together by interlocking fastener plates or self-adhesive decals affixed to the top and bottom surfaces at the junction of the blade arms. The top and bottom surfaces have optically perceived indicia on them to increase the toy's appearance and can be used to display a wide range of information including graphics, logos, advertisement, sales, and promotional information.

Another embodiment of the present invention is a flying ring toy with airfoil-like tapered perimeter edges for improved flight performance made by die cutting two circles of varying radii, which circumscribe the blade arms of the boomerang type flying toy. In essence this flying ring is a bonus toy, which adds virtually no additional cost in the manufacturing of the boomerang flying toy. Additionally, the flying ring toy requires no assembly by the user and has optically perceived indicia on the top and bottom surfaces.

Another embodiment of the present invention is a method of making the boomerang and flying ring toys in combination by die cutting a sheet of thin, lightweight planar material comprising a foam center sandwiched between top and bottom opposed parallel surfaces of paperboard stock.

It is therefore an object of the present invention to provide a flying toy that is simple and inexpensive to manufacture, package, ship, and display.

It is yet another object of the present invention to provide a safe, fun, and easy-to-use flying toy that is easily assembled and requires no testing or manipulation of its parts to perform as intended with enhanced flight performance characteristics, such as return flight.

It is a further object of the present invention to have optically perceived indicia on the top and bottom surfaces of the flying toys, which can readily be used for advertisement or promotional information. The optically perceived indicia can be spin indicia that generates an image when the flying toy is spinning through the air.

It is a further object of the present invention to provide a method for manufacturing a flying toy by simply die cutting the flying toy from a sheet of planar material. According to another aspect of the present invention, an additional flying ring toy is provided with virtually no additional cost to manufacture by merely making two additional circular die cuts.

Other features and advantages of the invention will become apparent from the following detailed description, taken in conjunction with the accompanying drawings, which illustrate, by way of example, various features of embodiments of the invention.

BRIEF DESCRIPTION OF THE DRAWINGS

These as well as other features of the present invention will become more apparent upon reference to the accompanying drawings wherein like numerals designate corresponding parts in the several figures.

FIG. 3 is a plan view of the boomerang toy and flying ring toy in the pre-assembled state.

FIG. 4 is an exploded perspective view of the boomerang with one blade arm and two self-adhesive decals disassembled therefrom.

DETAILED DESCRIPTION OF THE PREFERRED EMBODIMENTS

The following detailed description and accompanying drawings are provided for purposes of illustrating and describing presently preferred embodiments of the invention and are not intended to limit the scope of the invention in any way. It will be recognized that further embodiments of the invention may be used.

Figure 1:
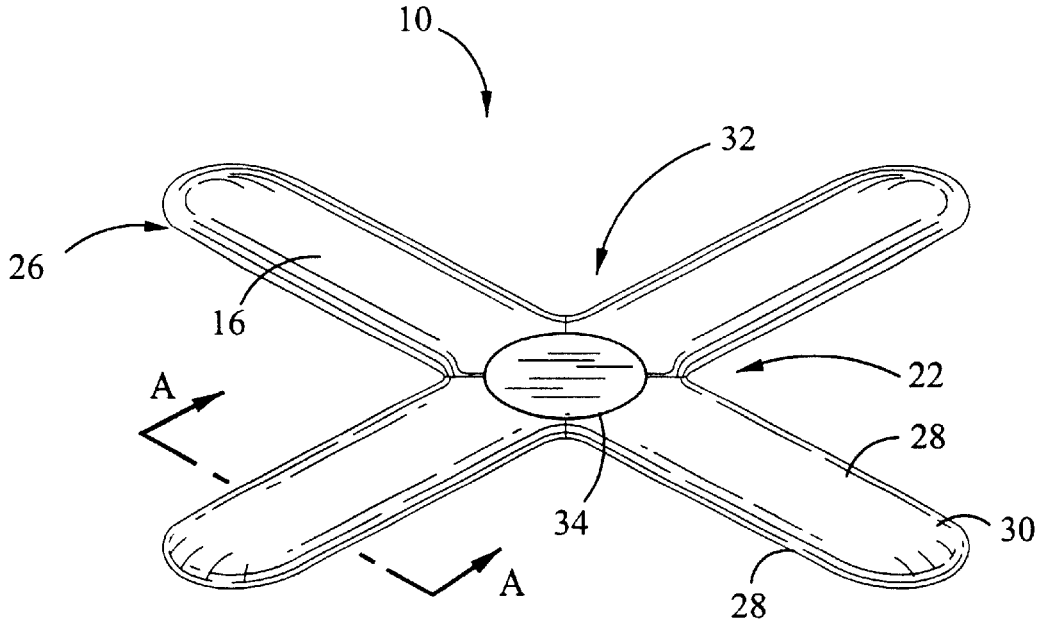
FIG. 1 is a perspective view of the boomerang toy.

Referring now to the drawings wherein FIG. 1 shows a perspective view of the boomerang toy 10, shown having four approximately equal length blade arms 20 die cut from a thin, lightweight sheet of planar material 12 having a foam center 14 sandwiched between a top and a bottom opposed parallel surface 16 and 18 respectively, made of paperboard stock. The blade arms 20 have airfoil-like tapered perimeter edges 30 formed by the die cut blades 46 leaving the top opposed parallel surface 16 permanently compressed to a position closer to the bottom opposed parallel surface 18, along die cut lines 28. The tapered edges 30, as can more readily be seen in FIG. 5, act as airfoils to enhance flight performance characteristics, such as return flight.

The blade arms 20 are coupled together with a self-adhesive decal 34 affixed to the top opposed parallel surface 16 at a central hub portion 32, which is defined by the junction of the blade arm proximal ends 22. The blade arms 20 extend radially outward from the central hub portion 32 to their respective blade arm distal ends 26 at equal angular spacing. As shown in FIG. 1, the particular embodiment of the boomerang toy has blade arm distal ends 26, which are generally circular curves. Both the top and bottom opposed parallel surfaces 16 and 18, respectively, can have optically perceived indicia 36 thereon as shown in the preassembled view of FIG. 3.

Figure 2:
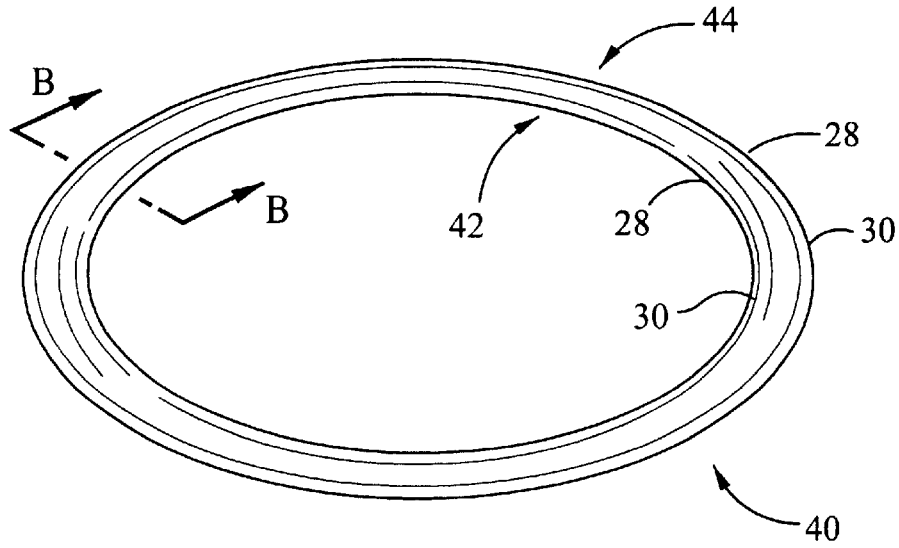
FIG. 2 is a perspective view of the flying ring toy.

FIG. 2 is a perspective view of the flying ring toy 40, which is made by die cutting an inner radius 42, and an outer radius 44, both circumscribing the plurality of blade arms 20, which are die cut in a side-by-side lengthwise placement, as more readily seen in FIG. 3. The flying ring toy 40 also has airfoil-like tapered edges 30 along the die cut lines 28 of both the inner and outer radius perimeters 42 and 44, respectively. The tapered edges act like airfoils to enhance the flight characteristics of the flying ring by making use of the air currents through which it moves. The tapered perimeter edges 42 and 44, are formed by the die cut blades 46 during the die cutting process as discussed above for the boomerang toy blade arms 20. Both the top opposed parallel surface 16, and bottom opposed parallel surface 18, can have optically perceived indicia 36 on their surfaces as shown in the preassembled view depicted in FIG. 3.

FIG. 3 is a plan view looking down at the top opposed parallel surface 16 of both the boomerang and flying ring toys 10 and 40, respectively, in their pre-assembled state, as they would look just after being die cut. The four blade arms 20 of the boomerang toy are shown in a lengthwise side-by-side placement and circumscribed by the inner and outer radius perimeters 42 and 44, respectively, of the flying ring toy 40. This configuration minimizes both the amount of cuts to be made and the amount of excess material wasted, which decreases the cost to manufacture the flying toys.

The blade arms 20 are shown with tongue and groove interlocks 24 at their proximal ends 22 for connecting one blade arm together with adjacent blade arms such that the tongue of one blade arm snap-fits into the groove of the adjacent blade arm to maintain the blade arms together at the central hub portion 32. The tongue and groove interlocks 24 facilitate affixing the self-adhesive decal 34 to the central hub portion and provide increased strength and stability to the boomerang toy 10. The blade arms 20 and flying ring toy are releasably held together after die cutting by small connection points 38 spaced apart along the die cut lines 28, which are left uncut during die cutting. These connection points facilitate the packaging, shipping, and display of the flying toys and are easily separated by applying opposing pressure to the top and bottom opposed parallel surfaces 16 and 18, respectively, at the small points of connection 38, or by simply cutting the small connection points 38 with a pocket knife or exacto-blade. The blade arms and inner and outer radii die cut lines 28 are die cut with sufficient pressure to permanently displace the top opposed parallel surface 16 to a position closer to the bottom opposed parallel surface 18 along the die cut lines, which creates tapered edges 30 that function as airfoils to enhance flight performance characteristics of the flying toys.

FIG. 3 further shows optically perceived indicia 36 on the top opposed parallel surface 16 of the boomerang and flying ring toys. The bottom opposed parallel surface 18 can also have optically perceived indicia 36 thereon. The optically perceived indicia can be used to display a wide range of information including graphics, logos, advertisement, sales, and promotional information.

FIG. 4 shows an exploded perspective view of the boomerang flying toy 10 with one blade arm 20 and two self-adhesive decals 34 disassembled therefrom. Each blade arm 20 has a tongue that snap-fits into the groove of the adjacent blade arm 20 to maintain the plurality of blade arms together in a precise formation to facilitate affixing the self-adhesive decal 34 on the top or bottom surface 16 or 18, respectively, at the central hub portion 32. The tongue and groove interlocks 24 also increase the stability of the assembly of blade arms. The embodiment shown in FIG. 4 has two self-adhesive decals 34, one for affixing to the top opposed parallel surface 16 and another for affixing to the bottom opposed parallel surface 18. Also shown are the airfoil-like tapered perimeter edges 30 of the blade arms 20 along the die cut lines 28, which enhance the flight characteristics of the boomerang toy.

Figure 5:
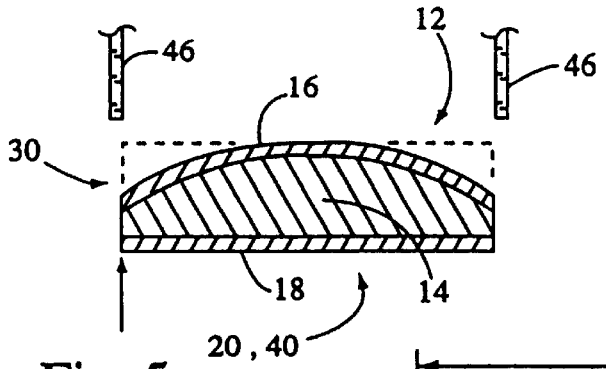
FIG. 5 is a cross-sectional view of a blade arm and the flying ring along section lines A—A, and B—B, respectively.

FIG. 5 is a cross-sectional view of a blade arm 20 taken along line A—A in FIG. 1, and the flying ring 40 taken along line B—B in FIG. 2. The flying toys are made from a sheet of thin, lightweight planar material 12, which has a foam center 14 sandwiched between top and bottom opposed parallel surfaces, 16 and 18 respectively, of paperboard stock. The tapered perimeter edges 30 are created during the die cut process by the die cut-blades 46 applying sufficient force to the thin, lightweight sheet of planar material 12, such that the top opposed parallel surface 16 near the die cut edge is permanently compressed to a position closer to the bottom opposed parallel surface 18 along the die cut lines 28. The tapered edges give the flying toys enhanced flight performance without adding any additional structure and without requiring additional forming steps such as hot pressing.

Figure 6:
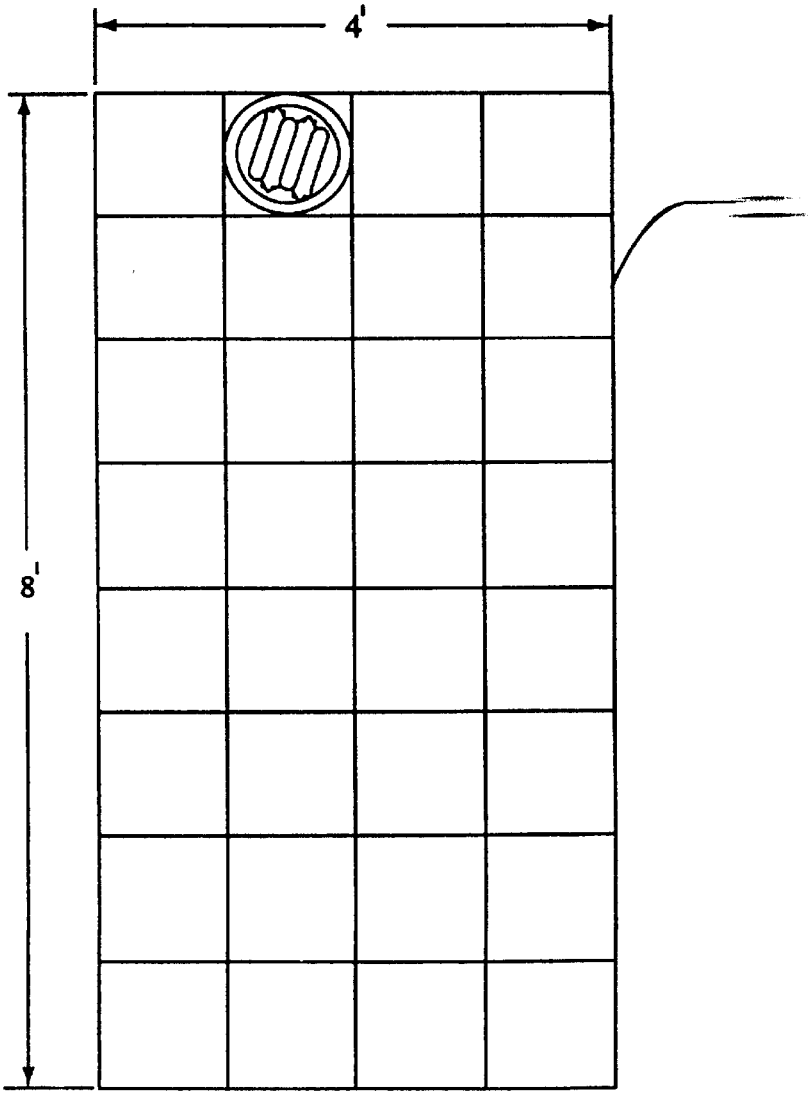
FIG. 6 is a plan view of a preformed 4'×8' sheet of planar material.

FIG. 6 is a plan view of a 4'×8' standard dimensioned preformed sheet of thin, lightweight planar material 12 showing the layout of the die cut locations for the die cutting of the boomerang 10 and flying ring toy 40. With the outer radius perimeter 44 of the flying ring toy 40 shown in FIG. 3 having a diameter of one foot or less, a single 4'×8' sheet of material will yield 32 boomerangs and 32 flying ring toys, with minimal wasted material. Additionally, the excess material outside the outer radius perimeter automatically breaks-away from the flying toys, leaving the plurality of blade arms of one boomerang toy and one flying ring toy detachably coupled together at the small connection points, and ready to be packaged and shipped without further preparation.

Figure 7:
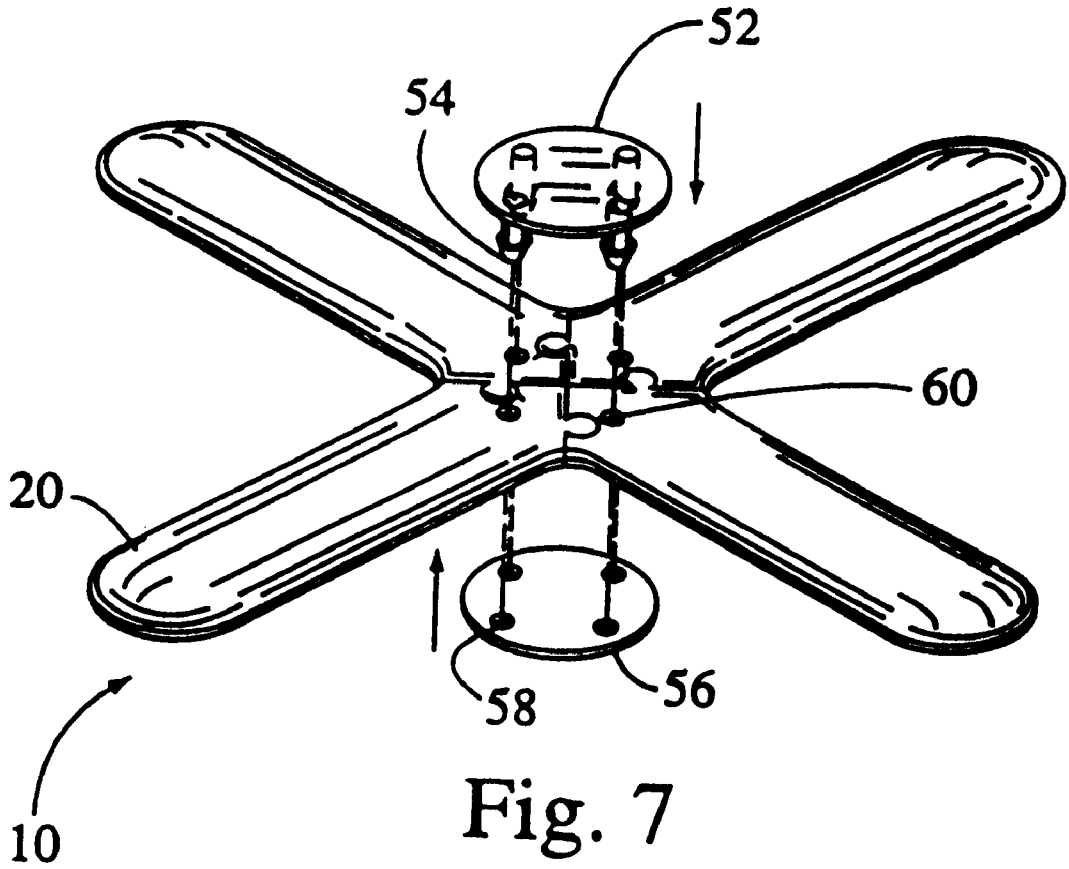
FIG. 7 is an exploded perspective view of the boomerang toy with fastener plates disassembled therefrom.

FIG. 7 shows an exploded perspective view of the boomerang toy 10 with interlocking fastener plates 50 disassembled therefrom. The plurality of blade arms 20 are coupled together at a central hub portion by a first fastener plate 52, which has a plurality of barbed posts 54 extending from a surface of the first fastener plate 52. The barbed posts 54 extend through corresponding blade arm apertures 60, and are locked into receiving apertures 58 in the second fastener plate 56 by the barbs as detailed in FIG. 8.

Figure 8:
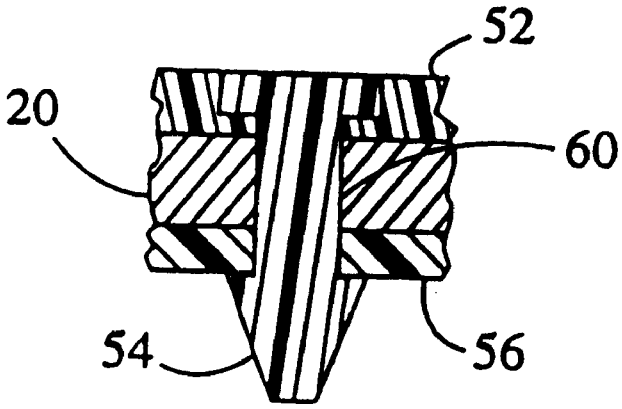
FIG. 8 is an enlarged detail plan view of a fastener plate barbed post.

The number of barbed posts 54 typically corresponds to the number of blade arms 20, so that each blade arm will have a barbed post extending through it to increase the strength of the assembly. As shown in FIG. 8, the barbed posts 54 are long enough to extend through the blade arms and the receiving apertures 58 in the second fastener plate 56, so that the barb slightly protrudes past the second fastener plate 56.

Having thus described the structural attributes of the boomerang and flying ring toys, the preferred methods of making the same will now be discussed. The preferred method of making the boomerang and flying ring toy consists of die cutting a plurality of blade arms arranged in a lengthwise side-by-side configuration, and two radii of varying diameter, which circumscribe the blade arms to form the flying ring toy. From one die cut, the preferred method yields the blade arm components of the boomerang toy and a bonus flying ring toy, with minimal amounts of unused material, and both having airfoil tapered edges without requiring additional steps such as hot pressing. Additionally, the top and bottom opposing surfaces can have optically perceived indicia thereon for displaying graphics, logos, advertisements, sales, and promotional information.

The method comprises the steps of preselecting a sheet of thin, lightweight planar material 12 having a synthetic resin closed cell foam core 14 sandwiched between top 16 and bottom 18 opposed parallel surfaces of paperboard stock. The top 16 and bottom 18 opposed parallel surfaces can have optically perceived indicia 36 on them for displaying graphics, logos, advertisements, sales, and promotional information.

A die cut layout is designed comprising a plurality of substantially equal length blade arms configured in a lengthwise side-by-side placement, with the inner and outer radii of the flying ring toy circumscribing the plurality of blade arms. With an outer radius diameter of approximately 12 inches, a single sheet of material with standard 4'×8' dimensions will yield 32 boomerangs and 32 flying ring toys. Although the sheet dimensions as shown in FIG. 6 are 4' wide by 8' long, it will be understood that other dimension sheets can readily be used with the same efficient use of materials by designing a layout for the die cut that varies proportionately with the sheet size of material used.

After the layout is designed, the planar sheet is placed in operative arrangement with a die cutting tool, wherein sufficient force is applied to the die cutting blades to form airfoil-like tapered edges by the top opposed parallel surface being permanently compressed to a position closer to the bottom opposed parallel surface along the die cut lines. The airfoil-like tapered edges give the flying toys enhanced flight performance without any additional parts and without requiring any additional forming steps such as hot pressing. Small points of connection spaced apart along the die cut lines are left uncut to releasably maintain the plurality of blade arms and flying ring toy together. The boomerang blade arms and flying ring toy are easily separated from each other by applying opposing pressure to the components at the small connection points, or by simply cutting the small connection points with a pocket knife, exacto-blade or other similar instrument. The design, layout, and releasably coupling together of the blade arms and flying ring allow the flying toys to be simply and inexpensively manufactured, packaged, shipped, and displayed by minimizing the amount of die cuts required, minimizing the size of the item to be packaged and shipped, and minimizing the amount of unused material.

Once detached, the flying ring toy is ready for use, without any further assembly. The assembly of the blade arms of the boomerang flying toy requires the blade arms to be placed together at their proximal ends, by snap-fitting the interlocking tongue and groove of each blade arm with the adjacent blade arms' corresponding tongue or groove and then coupling them together at the central hub portion by either affixing self-adhesive decals to the top and bottom opposed parallel surfaces, or by interlocking a first fastener plate having a plurality of barbed posts extending from one surface, through apertures in the blade arms, and locking the barbed posts into receiving apertures in a second fastener plate. The boomerang flying toy is then ready for use without any further assembly or fine tuning.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive; the scope of the invention being indicated by the appended claims, rather than the foregoing description, and all changes which come within the meaning and range of equivalency of the claims are therefore intended to be embraced therein.

What is claimed is:

1. A method of making a flying toy comprising the steps of:

preselecting a thin, lightweight planar material having top and bottom opposed parallel surfaces;

designing a die cut layout of the flying toy comprising a plurality of substantially equal length blade arms in a lengthwise side-by-side placement and circumscribing the plurality of blade arms with two circles of varying radii to form a flying ring toy;

placing the planar sheet in operative arrangement with a die cutting tool, wherein sufficient force is applied to the die cutting tool such that a tapered edge is formed by the tip opposed parallel surface being permanently displaced to a position closer to the bottom opposed parallel surface along die cut lines, wherein small points of connection spaced apart along the die cut lines are left uncut to releasably maintain the blade arms together.

2. The method of claim 1 wherein the thin, lightweight planar material is a standard size sheet of synthetic resin closed cell foam material.

3. The method of claim 1 wherein the thin lightweight planar material is a standard size sheet having a synthetic resin closed cell foam center sandwiched between top and bottom opposed parallel surfaces of paperboard stock.

4. The method of claim 1 wherein at least a portion of at least one of the opposed parallel surfaces has optically perceived indicia thereon.

5. The method of claim 1 wherein at least a portion of both opposed parallel surfaces has optically perceived indicia thereon.

6. The method of claim 1 further comprising the steps of:

separating the blade arms by severing the small connection points;

coupling together the plurality of equal length blade arms at their proximal ends with a first and second fastener plate by sliding a plurality of barbed posts extending from a surface of the first fastener plate, through apertures in the blade arm proximal ends and locking the barbed posts into receiving apertures in the second fastener plate, forming a central hub portion with the blade arms extending radially outward from the central hub portion to their respective blade arm distal ends at approximately equal angular spacing.

7. The method of claim 6 wherein each of the plurality of blade arms has a tongue and a groove at its proximal end, and before the step of affixing the self-adhesive decal to at least one of the opposed parallel surfaces, said method further comprises the step of:

interlocking the tongue of each blade arm together with the adjacent blade arms' corresponding groove.

8. The method of claim 1 further comprising the steps of:

separating the blade arms by severing the small connection points;

coupling together the plurality of equal length blade arms at their proximal ends by affixing at least one self-adhesive decal to at least one of the opposed parallel surfaces forming a central hub portion with the blade arms extending radially outward from the central hub portion to their respective blade arm distal ends at equal angular spacing.

9. The method of claim 8 wherein each of the plurality of blade arms has a tongue and a groove at its proximal end, and before the step of affixing the self-adhesive decal to at least one of the opposed parallel surfaces, said method further comprises the step of:

interlocking the tongue and groove of each blade arm together with the adjacent blade arms' corresponding tongue or groove.

10. A method of making a flying toy comprising the steps of:

preselecting a thin, lightweight planar material having top and bottom opposed parallel surfaces;

designing a die cut layout of the flying toy comprising a plurality of substantially equal length blade arms in a lengthwise side-by-side placement;

placing the planar sheet in operative arrangement with a die cutting tool, wherein sufficient force is applied to the die cutting tool such that a tapered edge is formed by the tip opposed parallel surface being permanently displaced to a position closer to the bottom opposed parallel surface along die cut lines, and wherein small points of connection spaced apart along the die cut lines are left uncut to releasably maintain the blade arms together;

separating the blade arms by severing the small connection points; and coupling together the plurality of equal length blade arms at their proximal ends with a first and second fastener plate by sliding a plurality of barbed posts extending from a surface of the first fastener plate, through apertures in the blade arm proximal ends and locking the barbed posts into receiving apertures in the second fastener plate, forming a central hub portion with the blade arms extending radially outward from the central hub portion to their respective blade arm distal ends at approximately equal angular spacing.

11. The method of claim 10 wherein each of the plurality of blade arms has a tongue and a groove at its proximal end, and before the step of affixing the self-adhesive decal to at least one of the opposed parallel surfaces, said method further comprises the step of:

interlocking the tongue of each blade arm together with the adjacent blade arms' corresponding groove.

12. The method of claim 10 wherein the thin, lightweight planar material is a standard size sheet of synthetic resin closed cell foam material.

13. The method of claim 10 wherein the thin, lightweight planar material is a standard size sheet having a synthetic resin closed cell foam center sandwiched between top and bottom opposed parallel surfaces of paperboard stock.

14. The method of claim 10 wherein at least a portion of at least one of the opposed parallel surfaces has optically perceived indicia thereon.

15. The method of claim 10 wherein at least a portion of both opposed parallel surfaces has optically perceived indicia thereon.

16. A method of making a flying toy comprising the steps of:

preselecting a thin, lightweight planar material having top and bottom opposed parallel surfaces;

designing a die cut layout of the flying toy comprising a plurality of substantially equal length blade arms in a lengthwise side-by-side placement;

placing the planar sheet in operative arrangement with a die cutting tool, wherein sufficient force is applied to the die cutting tool such that a tapered edge is formed by the tip opposed parallel surface being permanently displaced to a position closer to the bottom opposed parallel surface along die cut lines, and wherein small points of connection spaced apart along the die cut lines are left uncut to releasably maintain the blade arms together;

separating the blade arms by severing the small connection points; and coupling together the plurality of equal length blade arms at their proximal ends by affixing at least one self-adhesive decal to at least one of the opposed parallel surfaces forming a central hub portion with the blade arms extending radially outward from the central hub portion to their respective blade arm distal ends at equal angular spacing.

17. The method of claim 16 wherein each of the plurality of blade arms has a tongue and a groove at its proximal end, and before the step of affixing the self-adhesive decal to at least one of the opposed parallel surfaces, said method further comprises the step of:

interlocking the tongue and groove of each blade arm together with the adjacent blade arms' corresponding tongue or groove.

18. The method of claim 16 wherein the thin, lightweight planar material is a standard size sheet of synthetic resin closed cell foam material.

19. The method of claim 16 wherein the thin, lightweight planar material is a standard size sheet having a synthetic resin closed cell foam center sandwiched between top and bottom opposed parallel surfaces of paperboard stock.

20. The method of claim 16 wherein at least a portion of at least one of the opposed parallel surfaces has optically perceived indicia thereon.

* * * * *